US012037858B2

(12) United States Patent
Hallundbæk

(10) Patent No.: US 12,037,858 B2
(45) Date of Patent: Jul. 16, 2024

(54) DOWNHOLE POSITIVE DISPLACEMENT PUMP

(71) Applicant: Welltec A/S, Allerød (DK)

(72) Inventor: Jørgen Hallundbæk, Zug (CH)

(73) Assignee: WELLTEC A/S, Allerød (DK)

( * ) Notice: Subject to any disclaimer, the term of this patent is extended or adjusted under 35 U.S.C. 154(b) by 68 days.

(21) Appl. No.: 17/487,660

(22) Filed: Sep. 28, 2021

(65) Prior Publication Data

US 2022/0098946 A1 Mar. 31, 2022

(30) Foreign Application Priority Data

Sep. 29, 2020 (EP) ..... 20199041

(51) Int. Cl.
*E21B 23/04* (2006.01)
*E21B 23/06* (2006.01)
(Continued)

(52) U.S. Cl.
CPC ..... *E21B 23/0419* (2020.05); *E21B 23/06* (2013.01); *E21B 33/127* (2013.01); *E21B 33/1275* (2013.01); *E21B 43/103* (2013.01); *F04B 17/03* (2013.01); *F04B 47/06* (2013.01); *F04B 53/10* (2013.01); *F04B 53/16* (2013.01)

(58) Field of Classification Search
CPC .... E21B 23/0419; E21B 23/06; E21B 33/127; E21B 33/1275; F04B 17/03; F04B 47/06; F04B 53/10; F04B 53/16
See application file for complete search history.

(56) References Cited

U.S. PATENT DOCUMENTS 2,856,006 A 10/1958 Buck et al.
3,083,774 A 4/1963 Peters et al.
(Continued)

FOREIGN PATENT DOCUMENTS

EP 2 818 631 12/2014

OTHER PUBLICATIONS

Search Report for EP20199041.3 dated Mar. 11, 2021, 8 pages.
Communication Pursuant to Article 94(3) EPC mailed May 24, 2024 in European Application No. 21 783 513.1, 4 pages.

*Primary Examiner* — Robert E Fuller
(74) *Attorney, Agent, or Firm* — Nixon & Vanderhye P.C.

(57) ABSTRACT

A downhole double-acting positive displacement pump has a housing with a first end 1 and a second end, the housing having a pump inlet, a pump outlet arranged closer to the second end, a first chamber arranged in the housing and having a first outlet in fluid communication with the pump outlet, a first piston movable in the first chamber for pressing fluid out of the pump outlet, and a drive to reciprocate the first piston. The first piston divides the first chamber into a first and second chamber parts, the first chamber part having the first outlet and a first inlet, a first valve being arranged at the first outlet, a second valve being arranged in the first inlet. The second chamber part has a second outlet in fluid communication with the pump outlet and a second inlet, a third valve being arranged in the second outlet, and a fourth valve being arranged in the second inlet. The downhole pump further has a control unit for controlling an output of the drive into the movement of the first piston in the first direction or the second direction.

17 Claims, 10 Drawing Sheets

(51) Int. Cl.

| | |
|---|---|
| ***E21B 33/127*** | (2006.01) |
| ***E21B 43/10*** | (2006.01) |
| ***F04B 17/03*** | (2006.01) |
| ***F04B 47/06*** | (2006.01) |
| ***F04B 53/10*** | (2006.01) |
| ***F04B 53/16*** | (2006.01) |

(56) References Cited

U.S. PATENT DOCUMENTS

| | | | | |
|---|---|---|---|---|
| 4,541,783 | A | 9/1985 | Walling | |
| 6,307,290 | B1 | 10/2001 | Scarsdale | |
| 6,481,500 | B1 * | 11/2002 | Burd | E21B 43/128 166/374 |
| 2008/0196902 | A1 | 8/2008 | Head | |
| 2020/0102805 | A1 * | 4/2020 | Schroit | F04B 47/04 |

* cited by examiner

DOWNHOLE POSITIVE DISPLACEMENT PUMP

CROSS REFERENCE TO RELATED APPLICATION

This application claims priority to EP Patent Application No. 20199041.3 filed Sep. 29, 2020, the entire contents of which are hereby incorporated by reference.

The present invention relates to a downhole positive displacement pump for delivering an increased pressure downhole at a location in a well to perform an operation, the well producing hydrocarbon-containing fluid streaming up the well. The invention also relates to a downhole patch-setting tool for setting a patch within a well tubular metal structure.

BRIEF SUMMARY

Sucker rod pumps are well-known pumps used for pumping oil up from an artificial lift pumping system using a surface power source to drive a downhole pump assembly. A beam and crank assembly at the surface creates reciprocating motion in a sucker-rod string that connects to the downhole pump assembly. The pump assembly contains a plunger and valve assembly to convert the reciprocating motion to vertical fluid movement, i.e. positive displacement of a volume in order to lift hydrocarbon-containing fluid out of the well.

An electric downhole or submersible pump is used in heavy oil production and is designed with vane and fin configurations to accommodate frictional losses and pump efficiencies caused by heavy oil viscosity. The pump typically comprises several staged centrifugal pump sections that can be specifically configured to suit the production and wellbore characteristics of a given application. Electric submersible pump systems are a common artificial lift method providing flexibility over a range of sizes and output flow capacities in order to lift hydrocarbon-containing fluid out of the well.

Positive displacement pumps are a type of fluid pump in which the displacement volume of the pump is fixed for each rotation of the pump. Generally associated with high-pressure applications, positive displacement pumps are situated at the surface or on the rig and are commonly used in drilling operations to circulate the drilling fluid and in a range of oil and gas well treatments, such as cementing, matrix treatments and hydraulic fracturing.

None of the known pumps are suitable for submersion into the well while being able to deliver liquid at a high pressure in the well several kilometers down the well having a local high pressure.

It is an object of the present invention to wholly or partly overcome the above disadvantages and drawbacks of the prior art. More specifically, it is an object to provide an improved downhole positive displacement pump for delivering a high pressure to a confined space downhole in a well.

The above objects, together with numerous other objects, advantages and features, which will become evident from the below description, are accomplished by a solution in accordance with the present invention by a downhole positive displacement pump for delivering an increased pressure downhole at a location in a well to perform an operation, the well producing hydrocarbon-containing fluid streaming up the well, comprising:

a housing having a first end closest to a top of the well and a second end opposite the first end, the housing having a pump inlet and a pump outlet, where the pump outlet is arranged closer to the second end than to the first end, a first chamber arranged in the housing, the first chamber having a first outlet in fluid communication with the pump outlet, a first piston movable in the first chamber for pressing fluid out of the pump outlet, and a driving means for driving the first piston in a reciprocating movement between a first direction and an opposite second direction in the first chamber, and wherein the first piston divides the first chamber into a first chamber part and a second chamber part, the first chamber part comprising the first outlet and a first inlet, a first valve being arranged in the first outlet for allowing fluid to flow out of the first chamber part and preventing fluid from flowing into the first chamber part, a second valve being arranged in the first inlet for allowing fluid to flow into the first chamber part and preventing fluid from flowing out of the first chamber part; the second chamber part comprises a second outlet in fluid communication with the pump outlet and a second inlet, a third valve being arranged in the second outlet for allowing fluid to flow out of the second chamber part and preventing fluid from flowing into the second chamber part, and a fourth valve being arranged in the second inlet for allowing fluid to flow into the second chamber part and preventing fluid from flowing out of the second chamber part, and wherein the downhole positive displacement pump further comprises a control unit for controlling an output of the driving means into the movement of the first piston in the first direction or the second direction.

By having a first valve and a second valve, liquid may be sucked into the first chamber and out through the pump outlet in an easy manner to deliver highly pressurised liquid downhole, and the control unit ensures that the piston is able to move back and forth and repeat the ejection of highly pressurised liquid through the pump outlet.

The positive displacement pump may be a double-acting pump, which means that when the pressure is increased in the first chamber part the fluid may flow out of the first chamber part, and when the pressure is decreased in the second chamber part the fluid may flow/be sucked into the second chamber part, or vice versa. Thus, when the first chamber part is emptied the second chamber part is filled, and the first piston may apply the pressure increase to the first chamber part as well as the pressure reduction to the second chamber part when moving. By having the first outlet in fluid communication with the pump outlet or the second outlet in fluid communication with the pump outlet, the piston will provide pumping action when it is being moved in both the first direction and/or the second direction.

By providing a downhole double-acting positive displacement pump, the fluctuations in the pumping rate may be reduced, which means that the pumping action may be more even and predictable, and provide a constant output. Furthermore, the energy consumption of the pump may be reduced as the driving means provides pumping action in both directions, and the movement of the piston in one direction has a double function, i.e. to fill one chamber part and empty the other chamber part.

The downhole double-acting positive displacement pump has a piston, where both sides of the piston are engaged during operation, and where each stroke of the piston carries out both suction and expulsion at the same time.

Also, the fluid may be liquid.

Moreover, the well may have a well pressure being higher than the surface pressure.

In addition, the pump outlet may be arranged downstream of the pump inlet.

Furthermore, the pump outlet may be arranged closer to the bottom of the well than to the pump inlet.

Also, the downhole positive displacement pump may be a wireline downhole positive displacement pump.

Moreover, the driving means may be a second pump or an electric motor.

In addition, the control unit may comprise a first shaft connected to a reversing spindle driven by an output shaft of the electric motor, e.g. via a connecting gear.

Furthermore, the downhole positive displacement pump may be connected to the top via a wireline and a cable head.

Also, the downhole positive displacement pump may be a downhole wireline positive displacement pump.

Further, the downhole positive displacement pump may comprise an electrical control and a motor driving the second pump.

Moreover, the downhole positive displacement pump may comprise a compensator for keeping a predetermined overpressure in the downhole positive displacement pump compared to the surrounding pressure.

Furthermore, the first piston may be connected to a piston rod, and a second piston may be connected to the piston rod, the second piston being movable in a second chamber.

In one or more exemplary embodiments, the piston rod may be connected to a second driving means, where the second driving means may be configured to provide movement to a piston rod that may be connected to the first and/or the second piston. The second driving means may be a mechanical, hydraulic or electromechanical actuator that may provide movement to the piston rod in the first direction and/or the second direction. The second driving means may be separate from the first driving means or may be part of the first driving means.

Also, the second piston may divide the second chamber into a first chamber part and a second chamber part, the first chamber part comprising a first aperture, and the second chamber part comprising a second aperture.

Moreover, the second chamber and the second piston may form a second pump, where the second pump may be a double-acting pump, and where the first chamber part in the second chamber may be filled by suction while the second chamber part in the second chamber may be emptied by expulsion when the second piston is moved in the first direction and vice versa.

Furthermore, the control unit may, in a first position, direct pressurised fluid into the first chamber part of the second chamber and, in a second position, direct pressurised fluid into the second chamber part of the second chamber. The pressurised fluid may be provided by the second driving means, where the second driving means may e.g. provide a constant fluid pressure, and where the control unit may distribute selectively fluid pressure into the first chamber part and/or the second chamber part.

Thus, the second driving means providing the pressurised fluid may be an oil pump. The oil pump pumps pressurised fluid in a closed loop/system so that the pressurised fluid, i.e. the oil, is clean and not polluted by well fluid.

In addition, the second chamber may be part of a closed loop fluid system, where the fluid expelled from the volume on one side of the second piston may be used to fill the volume on the second side of the second piston. Thus, the risk of damaging the second piston by utilising drill/well fluid is reduced. This optionally means that the first chamber part of the second chamber and the second chamber part of the second chamber may comprise a third and a fourth outlet, respectively, where the third and fourth outlets may be connected to an input side of the driving means, and the output side of the driving means may be connected to the side of the piston which is being filled.

Furthermore, the downhole positive displacement pump may comprise the second driving means having a discharge opening for generating pressurised fluid to the second pump.

Also, the downhole positive displacement pump may comprise the second driving means in form of an oil pump having a discharge opening for generating pressurised fluid to the second pump.

Further, the discharge opening may be fluidly connected to the first aperture in a first position and fluidly connected to the second aperture in a second position.

Moreover, the control unit may be a flow control unit directing the fluid from the discharge opening to either the first aperture or the second aperture for moving the second piston in the second chamber of the second pump.

In addition, the second pump may be a feed pump.

Furthermore, the driving means may be a drill pipe or drill string for supplying pressurised fluid from the surface to drive the piston back and forth in the chamber.

Also, the control unit may comprise a valve unit comprising a valve chamber and a valve piston moving in the valve chamber between a first valve position and a second valve position, the valve chamber having a valve inlet fluidly connected with the discharge opening, a first valve outlet fluidly connected with the first aperture and a second valve outlet fluidly connected with the second aperture, and in the first valve position the valve inlet is fluidly connected with the first valve outlet, and in the second valve position the valve inlet is fluidly connected with the second valve outlet.

Further, the flow control unit may comprise a pivot arm having a first arm end part and a second arm end part, the second arm end part being connected with the valve piston in order to change between the first valve position and the second valve position.

Moreover, the pivot arm may pivot around a pivot point.

In addition, the pivot point may be arranged on the second moving part.

Furthermore, the pivot point may be fixedly connected with the housing.

Also, the pivot arm may have a first projection.

Further, the pivot point may be the first projection engaging the groove of the second moving part.

Moreover, the pivot arm may have a first projection and a second projection.

In addition, the control unit may comprise a first moving element, the first moving element having a projecting flange with a flange surface along which the first arm end part of the pivot arm moves.

Furthermore, the flow control unit may comprise a second moving element configured to move the first moving element.

In addition, the second moving element may have an element projection engaging a continuous groove in the first moving element.

Also, the second moving element may have a groove engaging a first end part of the first moving element.

Further, the first moving element may have a second end part connected to the pivot arm and a first end part engaging a groove in the second moving element.

Moreover, a spring may be connected to the first end part of the first moving part and connected to the second arm end part of the pivot arm.

In addition, the flow control unit may comprise a second moving element configured to move the pivot arm, the second moving element having a groove engaging a first projection of the pivot arm.

Furthermore, the second moving element may have a continuous groove having at least two points and at least two inclining parts.

Also, the flange surface may have a first surface end and a second surface end, the flange surface inclining from an intermediate point towards the first surface end in order to move the valve piston from the first valve position to the second valve position, and the flange surface inclining from the intermediate point towards the second surface end in order to move the valve piston from the second valve position to the first valve position.

Further, the fluid in the first chamber may be well fluid.

Moreover, the downhole positive displacement pump may comprise a discharge control unit for discharging fluid in the packer in order to deflate the packer.

In addition, the discharge control unit may be a flow-operated discharge control unit.

Furthermore, the discharge control unit may comprise an electrically operated valve which is operated through an electrical conductor passing through the housing.

Also, the discharge control unit may have a discharge outlet.

Further, the downhole positive displacement pump is not an electrical submersible pump (ESP).

Moreover, the downhole positive displacement pump does not comprise a plunger having at least one non-return valve, check valve or one-way valve.

In addition, the present invention relates to a downhole patch-setting tool for setting a patch within a well tubular metal structure, comprising a positive displacement pump as mentioned above and at least one inflatable packer arrangeable within a metal patch for expanding the metal patch in the well tubular metal structure.

Furthermore, the packer may have an expandable bladder being arranged around a base pipe, the expandable bladder being expanded via openings in the base pipe.

Also, the expandable bladder may be made of a deflatable material, such as rubber, elastomer, etc., and/or it may be made of a reinforced material.

Further, the expandable bladder may be connected to a base pipe by connecting sleeves.

Moreover, the downhole patch-setting tool for expanding an annular barrier being mounted as part of a well tubular metal structure may comprise a positive displacement pump as mentioned above and at least one annular barrier having an expandable metal sleeve surrounding a tubular metal part mounted as part of the well tubular metal structure, the downhole positive displacement pump comprising two packers mounted with a tool part having at least one opening between them so that a zone in the well tubular metal structure is isolated in order to expand the expandable metal sleeve of the annular barrier through an opening in the well tubular metal structure.

Finally, the opening may be arranged opposite a valve block of the annular barrier arranged at one end of the annular barrier.

BRIEF DESCRIPTION OF THE DRAWINGS

The invention and its many advantages will be described in more detail below with reference to the accompanying schematic drawings, which for the purpose of illustration show some non-limiting embodiments and in which.

DETAILED DESCRIPTION

All the figures are highly schematic and not necessarily to scale, and they show only those parts which are necessary in order to elucidate the invention, other parts being omitted or merely suggested.

Figure 1:
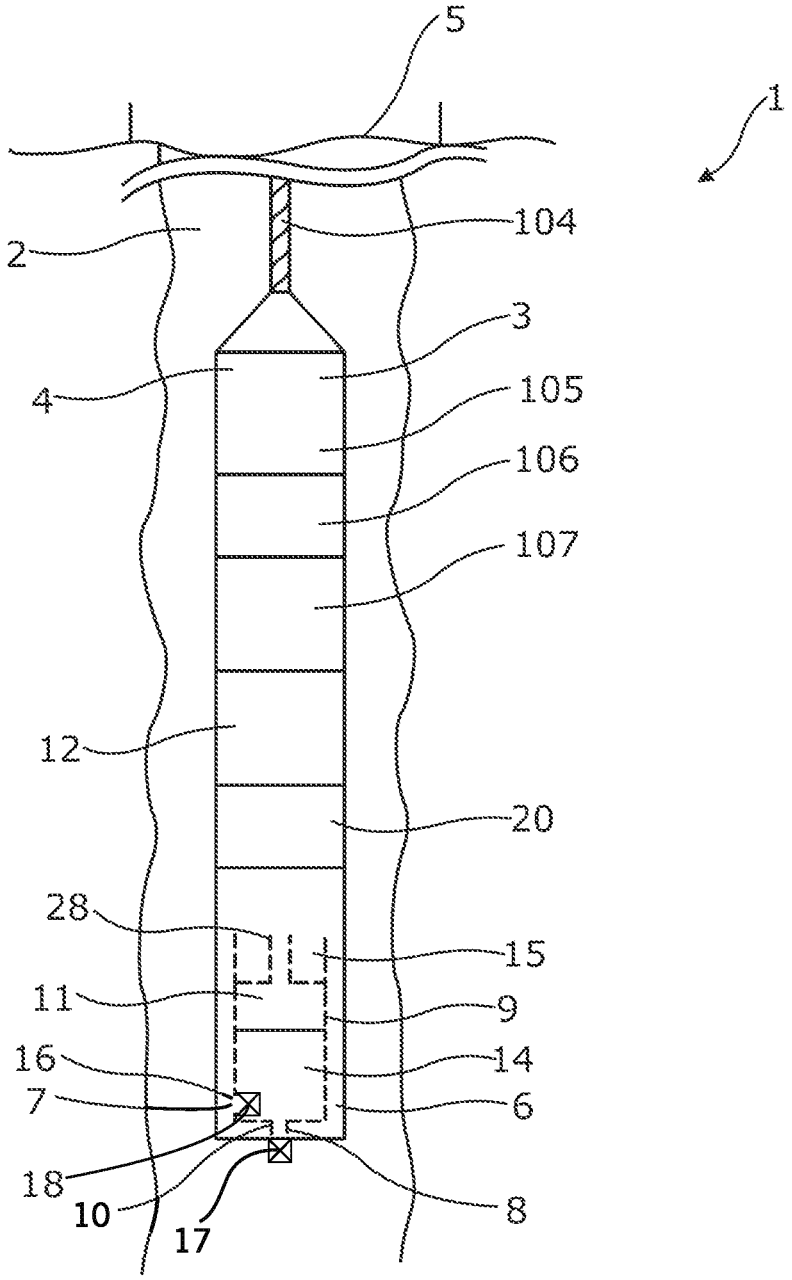
FIG. 1 shows a downhole positive displacement pump in a well for providing a high pressure of fluid in a confined space downhole.

FIG. 1 shows a downhole positive displacement pump 1 for delivering an increased pressure in a confined space downhole at a location in a well 2 to perform an operation, such as expanding a patch, expanding an annular barrier or providing fractures in a formation. The confined space may thus be in a packer, an annular barrier or between two packers for expanding a patch. The well 2 is configured to produce a hydrocarbon-containing fluid streaming up the well 2. The downhole positive displacement pump 1 comprises a housing 3 having a first end 4 closest to a top 5 of the well 2 and a second end 6 facing opposite the first end 4, i.e. facing down the well 2. The housing 3 has a pump inlet 7 and a pump outlet 8, where the pump outlet 8 is arranged closer to the second end 6 than to the first end 4. The downhole positive displacement pump 1 further comprises a first chamber 9 arranged in the housing 3, and the first chamber 9 has a first outlet 10 in fluid communication with the pump outlet 8 for delivering the increased pressure in a confined space downhole. A first piston 11 is movable in the first chamber 9 for pressing fluid out of the pump outlet 8, and a driving means 12 is configured to drive the first piston 11 in a reciprocating movement in a first direction or an opposite second direction in the first chamber 9. The first piston 11 divides the first chamber 9 into a first chamber part 14 and a second chamber part 15. The first chamber part 14 comprises the first outlet 10 and a first inlet 16. A first valve 17 is arranged in or in connection with the first outlet 10 for allowing fluid to flow out of the first chamber part 14 and preventing fluid from flowing into the first chamber part 14. A second valve 18 is arranged in or in connection with the first inlet 16 for allowing fluid to flow into the first chamber part 14 and preventing fluid from flowing out of the first chamber part 14. In this way, fluid surrounding the tool is sucked into the first chamber part 14 from the well 2 via the first inlet 16 during the movement of the first piston 11 away from the first inlet 16. During the movement of the first piston 11 in the opposite direction towards the first outlet 10, the fluid in the first chamber 9 is pressed out of the first chamber 9 through the first outlet 10 and further out of the pump outlet 8 into the confined space, e.g. in an annular barrier, a packer or a patch. The downhole positive displacement pump 1 further comprises a control unit 20 for controlling an output of the driving means 12 into the movement of the first piston 11 in the first direction and/or the second direction. The control unit 20 thus controls the movement direction of the first piston 11. The pump outlet 8 is arranged downstream of the pump inlet 7; thus, the pump outlet 8 is arranged closer to the bottom of the well 2 than to the pump inlet 7. Down the well 2, the well pressure is higher than the surface pressure. The downhole positive displacement pump 1 is a single-acting or double-acting downhole positive displacement pump, and the downhole positive displacement pump 1 is connected to a wireline and is a downhole wireline positive displacement pump.

Figure 2:
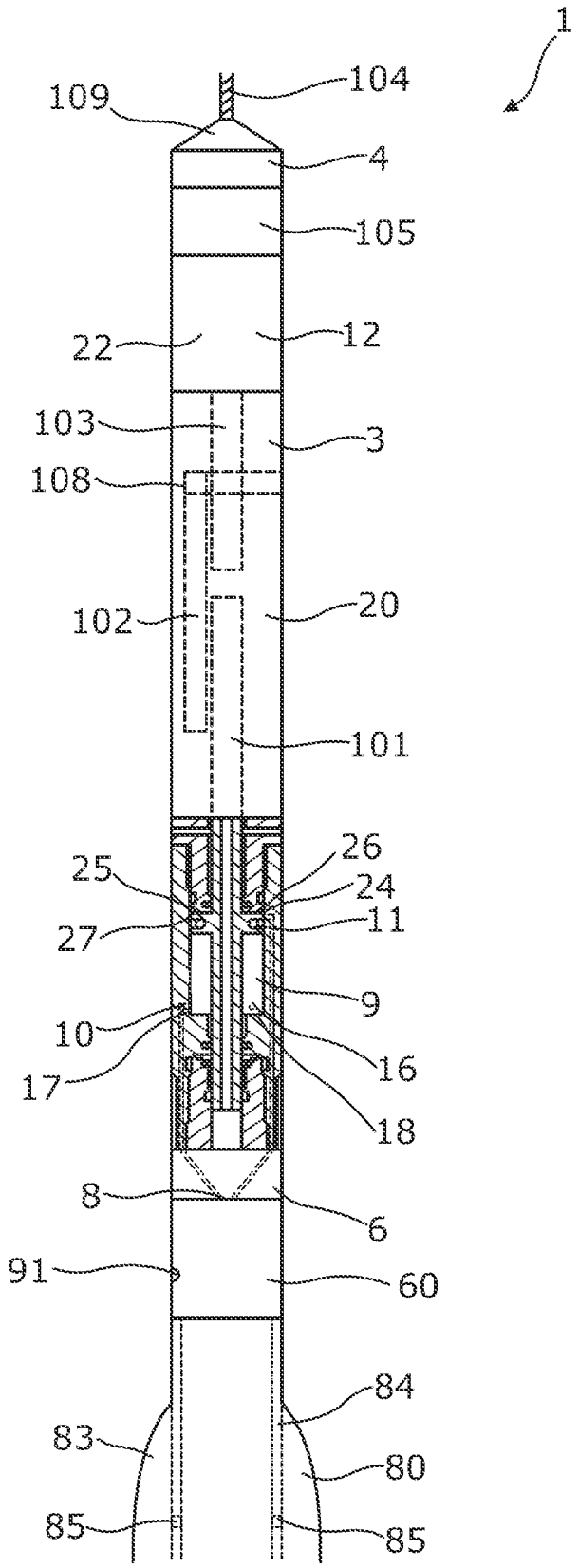
FIG. 2 shows a partly cross-sectional view of a downhole positive displacement pump providing a high pressure of fluid in a confined space of a packer for setting a patch downhole.
Figure 3:
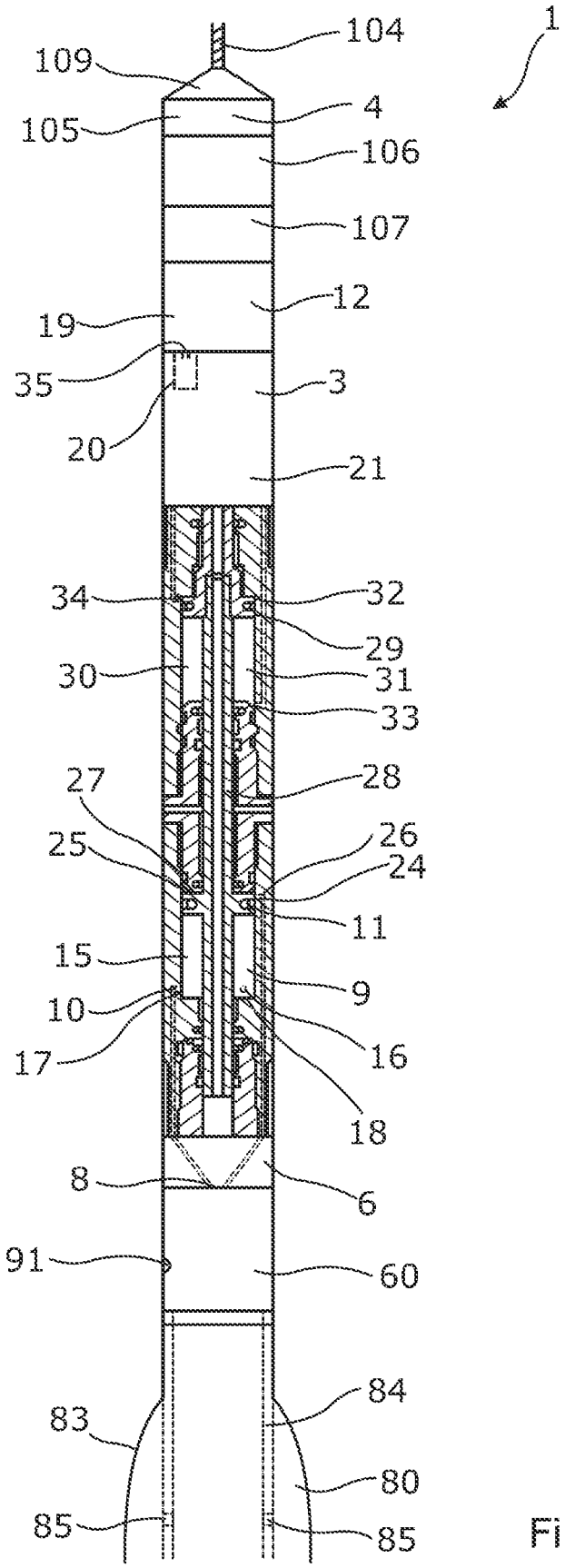
FIG. 3 shows a partly cross-sectional view of another downhole positive displacement pump providing a high pressure of fluid in a confined space of a packer for setting a patch downhole.

The driving means 12 is a second pump 21 in FIG. 3 or an electric motor 22 in FIG. 2. In FIG. 2, the control unit 20 comprises a first shaft 101 connected to a reversing spindle 102 (also called a self-reversing spindle) driven by an output shaft 103 of the electric motor 22, e.g. via a connecting gear 108.

In FIGS. 1-3 and 7-10, the downhole positive displacement pump 1 is connected to the top via a wireline 104 and a cable head 109. The downhole positive displacement pump 1 comprises an electrical control 105. In FIGS. 1, 3 and 7-10, the downhole positive displacement pump 1 comprises a motor 106 driving the second pump 21. The downhole positive displacement pump 1 may further comprise a compensator 107 for keeping a predetermined overpressure in the downhole positive displacement pump 1 compared to the surrounding pressure.

In FIGS. 2 and 3, the downhole positive displacement pump 1 is a downhole double-acting positive displacement pump, where the second chamber part 15 comprises a second outlet 24 in fluid communication with the pump outlet 8 and a second inlet 25. A third valve 26 is arranged in the second outlet 24 for allowing fluid to flow out of the second chamber part 15 and preventing fluid from flowing into the second chamber part 15. A fourth valve 27 is arranged in the second inlet 25 for allowing fluid to flow into the second chamber part 15 and preventing fluid from flowing out of the second chamber part 15. The second outlet 24 and the second inlet 25 are arranged in the part of the second chamber part 15 closest to the top 5 of the well 2. In the downhole double-acting positive displacement pump, the first piston 11, when moving in one direction, is able to suck fluid into the first chamber part 14 while pressing fluid in the second chamber part 15 out of the second outlet 24 and further out of the pump outlet 8, and when moving in the opposite direction the first piston 11 is able to suck fluid into the second chamber part 15 while pressing fluid in the first chamber part 14 out of the first outlet 10 and further out of the pump outlet 8. Thus, the pump is a downhole double-acting positive displacement pump using both an upstroke and a downstroke for providing fluid out of the pump outlet 8, and the pump is thus more efficient than a single-acting downhole positive displacement pump.

In FIG. 3, the driving means is a second pump 21. In order to drive the first piston 11, the first piston 11 is connected to a piston rod 28, and a second piston 29 is connected to another part of the piston rod 28; the second pump 21 pumps fluid into a second chamber 30 in which the second piston 29 is movable in the first direction and the opposite second direction. As the second piston 29 moves in the second chamber 30, it moves the first piston 11 back and forth, and in this way fluid is pumped into e.g. the packer 80 to inflate the packer 80. The second piston 29 divides the second chamber 30 into a first chamber part 31 and a second chamber part 32, and the first chamber part 31 comprises a first aperture 33, and the second chamber part 32 comprises a second aperture 34. A discharge opening 35 of a second driving means 19 in form of an oil pump 19 is fluidly connected with the first aperture 33 in a first position and fluidly connected with the second aperture 34 in a second position via the control unit 20 being a flow control unit.

The control unit 20 directs the fluid from the discharge opening 35 to either the first aperture 33 or the second aperture 34 for moving the second piston 29 in the second chamber 30 in the first direction or the second direction, respectively, and thereby controlling the movement of the first piston 11 in a first direction and a second opposite direction. The second pump 21 thus merely pumps fluid into the control unit 20, and the control unit 20 directs the fluid into the first chamber part 31 of the second chamber 30 to drive the first piston 11 away from the pump outlet 8 and into the second chamber part 32 of the second chamber 30 to drive the first piston 11 towards the pump outlet 8. The fluid in the first chamber 9 is well fluid, and the fluid in the second chamber 30 is tool fluid only flowing in the pump. By having a second pump 21 as a driving means 12, the pump can be made as a downhole double-acting positive displacement pump with a very small outer diameter, thus being energy-efficient. This is not possible in prior art pumps having a motor driving a gearing arrangement as known from e.g. U.S. Pat. No. 3,083,774.

The second pump 21 is thus a feed pump. In another embodiment, the driving means 12 may be a drill pipe or drill string for supplying pressurised fluid from the surface to drive the piston back and forth in the chamber.

Figure 4:
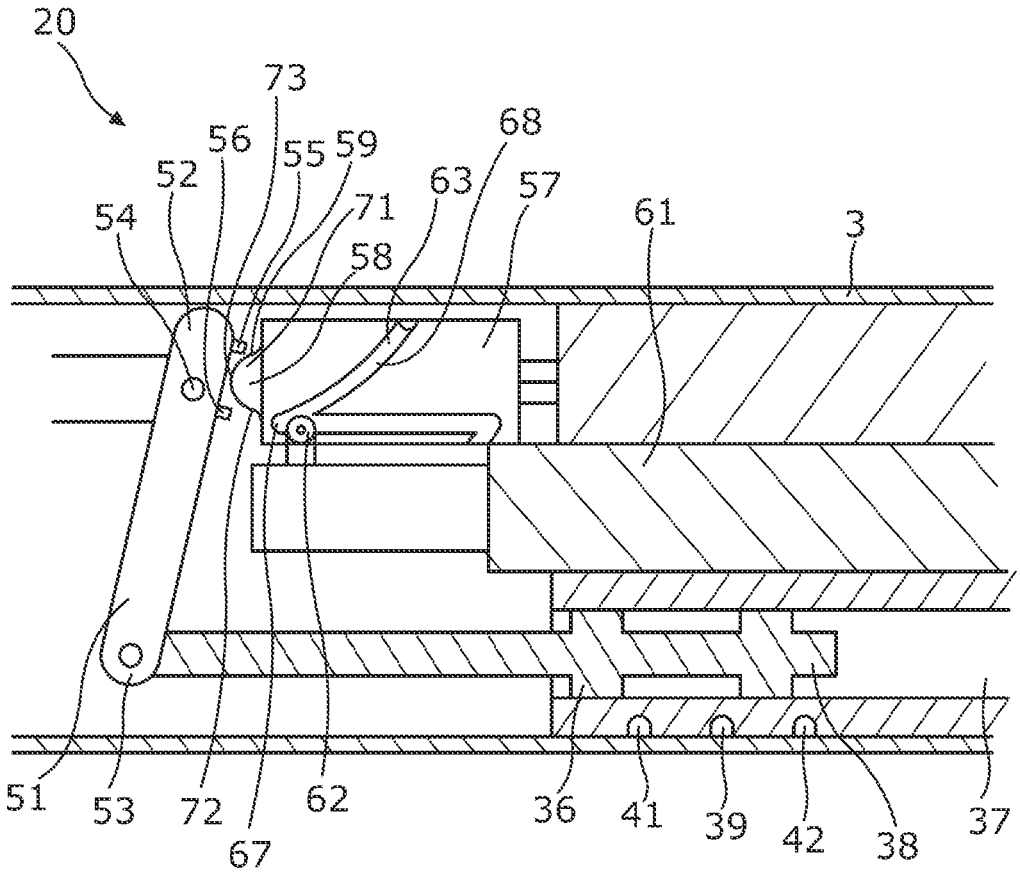
FIG. 4 shows a partly cross-sectional view of a control unit for controlling an output of the driving means into the movement of the first piston in the first direction or the second direction.
Figure 5:
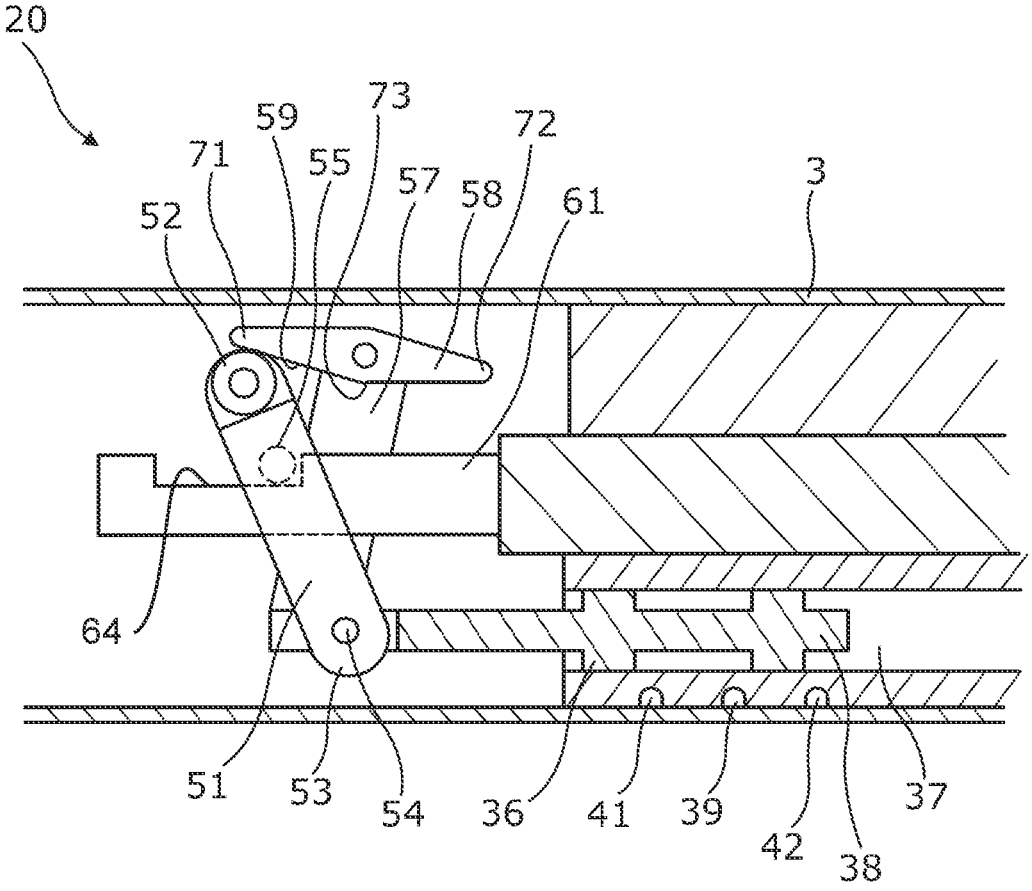
FIG. 5 shows a partly cross-sectional view of another control unit for controlling an output of the driving means into the movement of the first piston in the first direction or the second direction.
Figure 6:
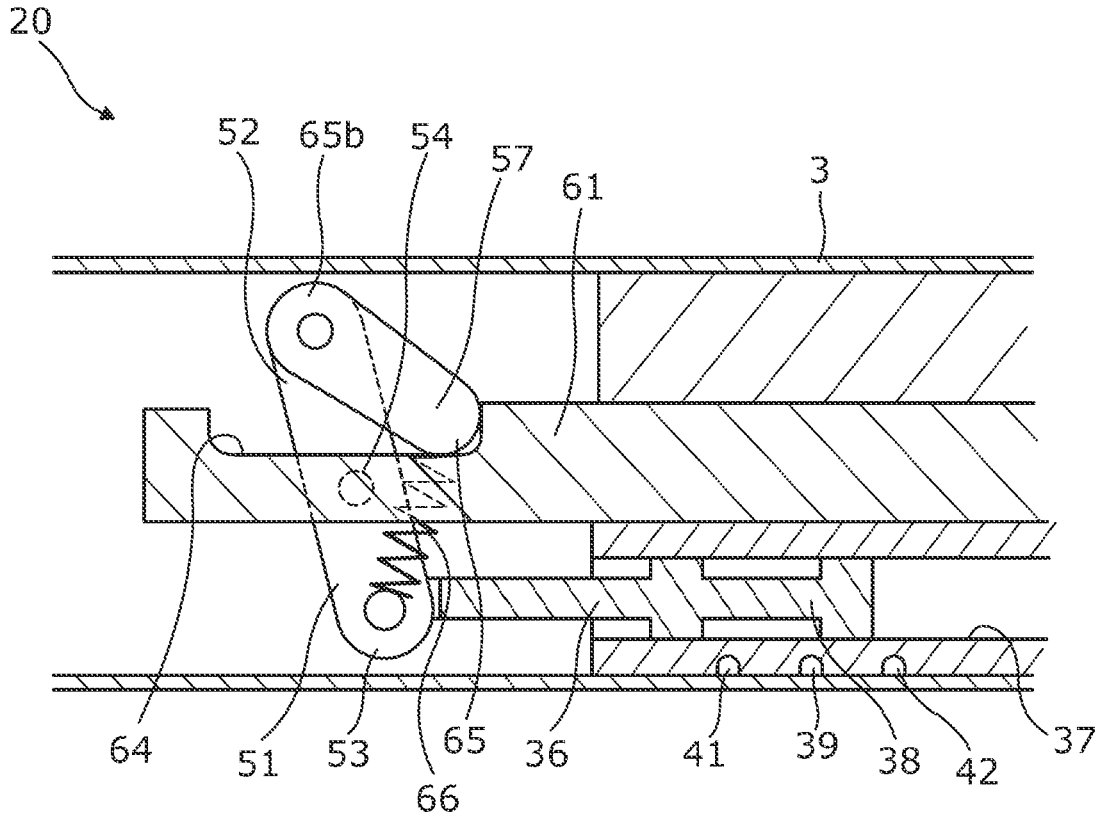
FIG. 6 shows a partly cross-sectional view of yet another control unit for controlling an output of the driving means into the movement of the first piston in the first direction or the second direction.

As shown in FIGS. 4-6, the control unit 20 comprises a valve unit 36 comprising a valve chamber 37 and a valve piston 38 moving in the valve chamber 37 between a first valve position and a second valve position. The valve chamber 37 has a valve inlet 39 fluidly connected with the discharge opening of the oil pump 19, a first valve outlet 41 fluidly connected with the first aperture 33 and a second valve outlet 42 fluidly connected with the second aperture 34. In the first valve position, the valve inlet 39 is fluidly connected with the first valve outlet 41, and in the second valve position the valve inlet 39 is fluidly connected with the second valve outlet 42. In this way, the fluid is directed to the first or the second chamber part 14, 15 of the second chamber 30. The control unit 20 further comprises a pivot arm 51 having a first arm end part 52 and a second arm end part 53. The second arm end part 53 is connected with the valve piston 38 in order to change between the first valve position and the second valve position. The pivot arm 51 pivots around a pivot point 54. The control unit 20 further comprises a first moving element 57 and a second moving element 61. The second moving element 61 moves the first moving element 57 and the pivot arm 51 so as to move the valve piston 38 in order to change between the first valve position and the second valve position. The second moving element 61 is moved by the piston rod 28. By having a control unit 20 driven by the piston rod 28 for changing the moving direction of the valve piston 38, the control unit 20 is not dependent on any electric switching mechanism and is therefore less likely to fail downhole.

In FIG. 4, the pivot point 54 is fixedly connected with the housing 3, and the pivot arm 51 has a first projection 55 and a second projection 56. The control unit 20 further comprises the first moving element 57, and the first moving element 57 has a projecting flange 58 having a flange surface 59 along which the first arm end part 52 of the pivot arm 51 moves. The control unit 20 further comprises the second moving element 61 configured to move the first moving element 57, which rotates due to the first moving element 57 having a continuous groove 63 with at least two points 67 and at least two inclining parts 68, into which continuous groove 63 an element projection 62 of the second moving element 61 engages. When the second moving element 61 moves back and forth as it is connected with the second piston 29, the element projection 62 moves in the continuous groove 63, rotating the first moving element 57 and thus the projecting flange 58, which pushes either the first projection 55 or the second projection 56, as a result of which the pivot arm 51 moves the valve piston 38 between the first and the second valve position. The flange surface 59 has a first surface end 71 and a second surface end 72, and the flange surface 59 inclines from an intermediate point 73 towards the first surface end 71 in order to move the valve piston 38 from the first valve position to the second valve position by engaging the first and second projections of the pivot arm 51. As the second moving element 61 moves in one direction along the inclining part 68, the projecting flange 58 is rotated, and when the intermediate point hits the first projection or the second projection, the pivot arm pivots, changing the valve position of the valve. The first moving element 57 is rotatably connected to the housing 3. The element projection 62 may be provided with a wheel or roller so as to ease the moving engagement with the continuous groove 63.

In FIG. 5, the pivot arm 51 has a first arm end part 52 and a second arm end part 53, and between the arm end parts 52, 53 is a first projection 55. The pivot arm 51 pivots around a pivot point 54 arranged at the second arm end part 53. The control unit 20 further comprises the first moving element 57, and the first moving element 57 has, in a first end, a projecting flange 58 having a flange surface 59 along which the first arm end part 52 of the pivot arm 51 moves. In a second end of the first moving element 57, the first moving element 57 is connected to the valve piston 38 for moving the valve piston 38 between the first valve position and the second valve position. The first arm end part 52 of the pivot arm 51 may be provided with a wheel or roller so as to ease the moving engagement with the flange surface 59. The flange surface 59 has a first surface end 71 and a second surface end 72, and the flange surface 59 inclines from an intermediate point 73 towards the first surface end 71 in order to move the valve piston 38 from the first valve position to the second valve position, and the flange surface 59 inclines from the intermediate point towards the second surface end 72 in order to move the valve piston 38 from the second valve position to the first valve position. In order to move easily past the intermediate point 73, the wheel or roller may be spring-loaded. Thus, the intermediate point is closer to the pivot point 54 than the first surface end 71 and the second surface end 72. When the first arm end part 52 of the pivot arm 51 is at the first surface end 71 and the second surface end 72, it is in its outermost position. The control unit 20 further comprises the second moving element 61 configured to move the first moving element 57 by pulling or pushing the first projection 55 of the pivot arm 51, which again moves the first moving element 57 past the intermediate point, resulting in a change of valve position. The second moving element 61 is connected with the second piston 29 and follows the back-and-forth movement of the second piston 29, thus moving a groove 64 of the second moving element 61, which groove 64 engages the first projection 55 of the pivot arm 51, forcing the pivot arm to change position via the first moving element 57, and moving the valve piston 38 between the first and the second valve position.

In FIG. 6, the pivot point 54 is arranged on the second moving element 61. The pivot arm 51 pivots around a pivot point 54, and at the second arm end part 53 the pivot arm 51 is connected to the valve piston 38. The control unit 20 further comprises the first moving element 57. The first moving element 57 has a second end part **65*b* connected to the first arm end part 52 of the pivot arm 51, and a first end part 65 of the first moving element 57 engages a groove 64 in the second moving element 61. The second moving element 61 is configured to move the first moving element 57, forcing the pivot arm 51 to pivot, resulting in a change of valve position. A spring 66 is connected to the first end part 65 of the first moving element 57 and connected to the second arm end part 53 of the pivot arm 51. The second moving element 61 is connected with the second piston 29 and follows the back-and-forth movement of the second piston 29, thus moving the groove 64 and the first moving element 57, resulting in the valve piston 38** changing position between the first and the second valve positions.

Figure 7:
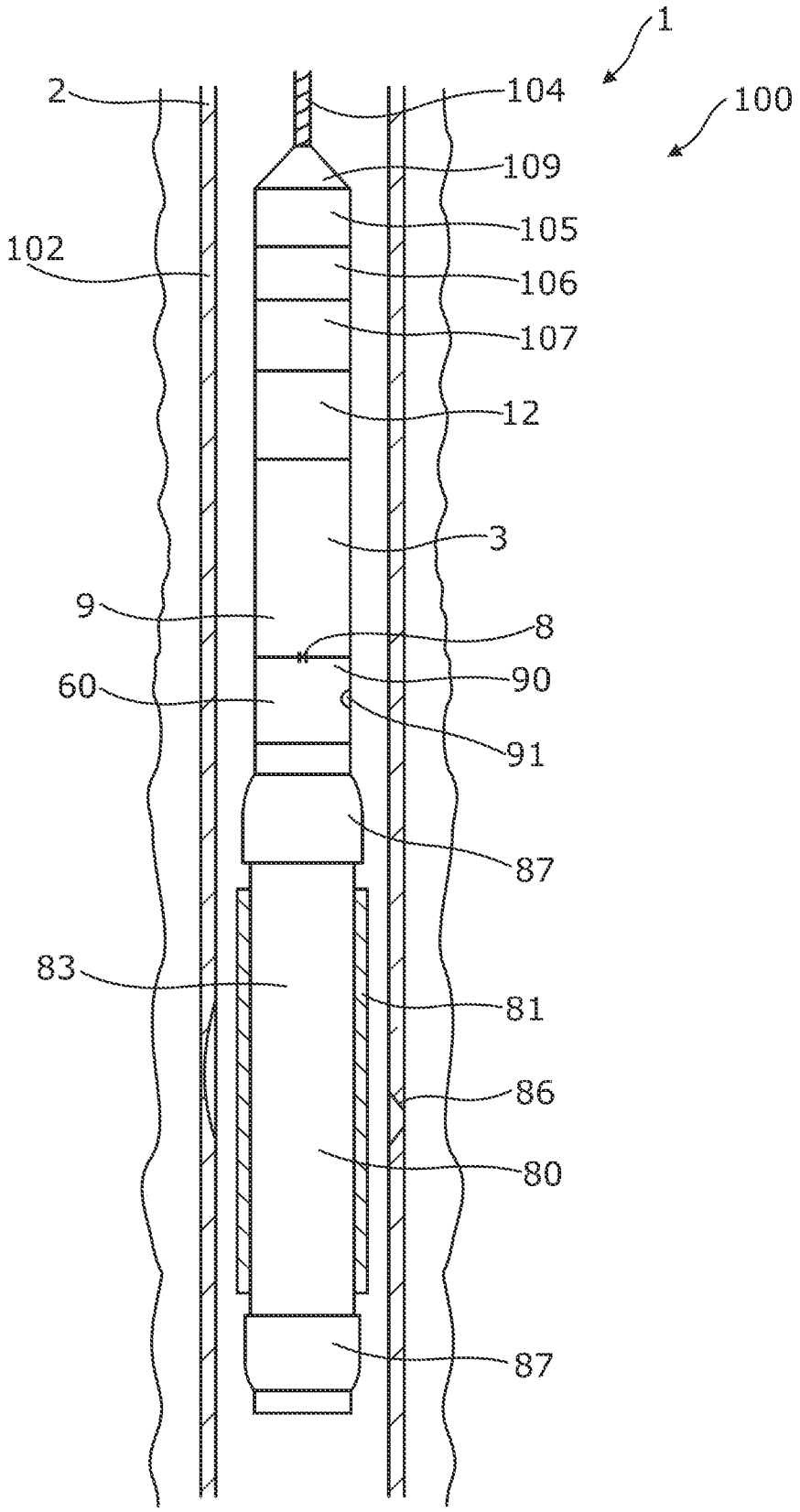
FIG. 7 shows a side view of another downhole positive displacement pump providing a high pressure of fluid in a confined space of a packer for setting a patch downhole.
Figure 9:
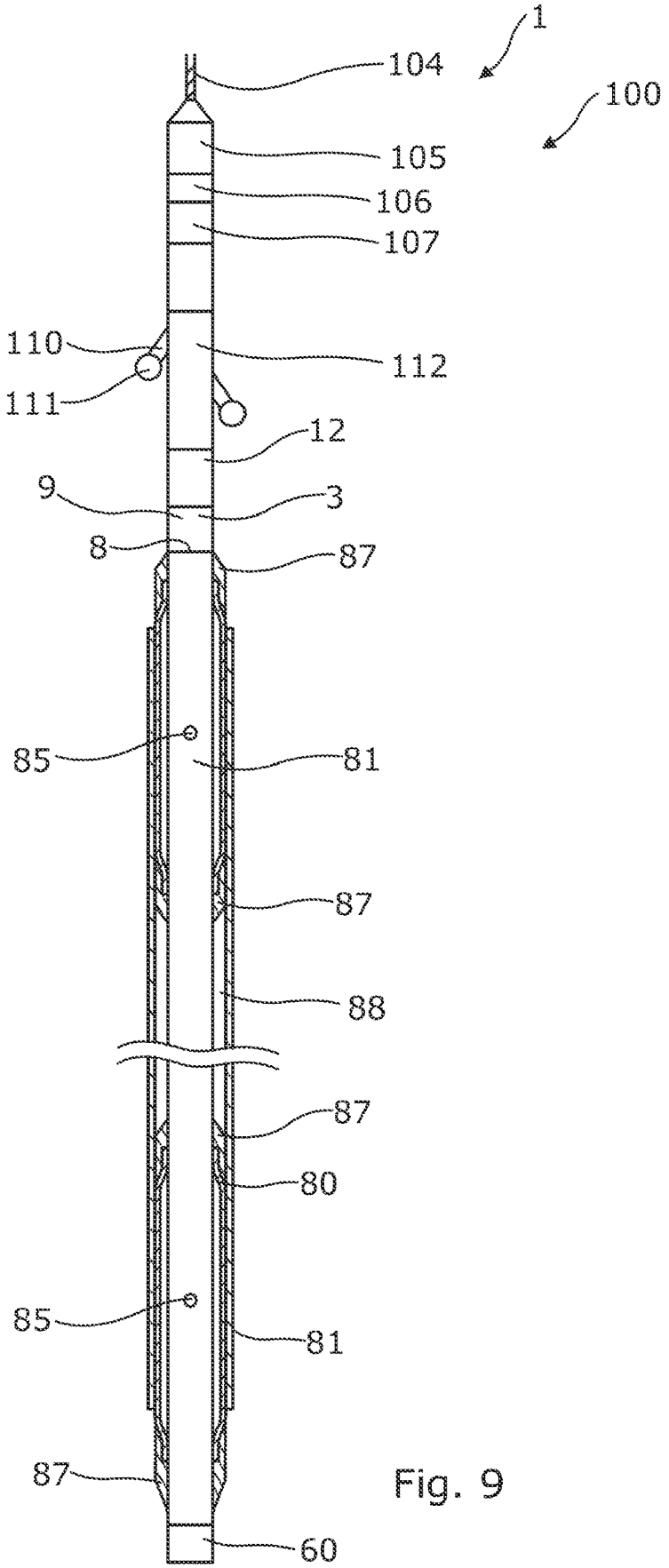
FIG. 9 shows a side view of another downhole positive displacement pump providing a high pressure of fluid in a confined space in each of two packers for setting a patch downhole.
Figure 10:
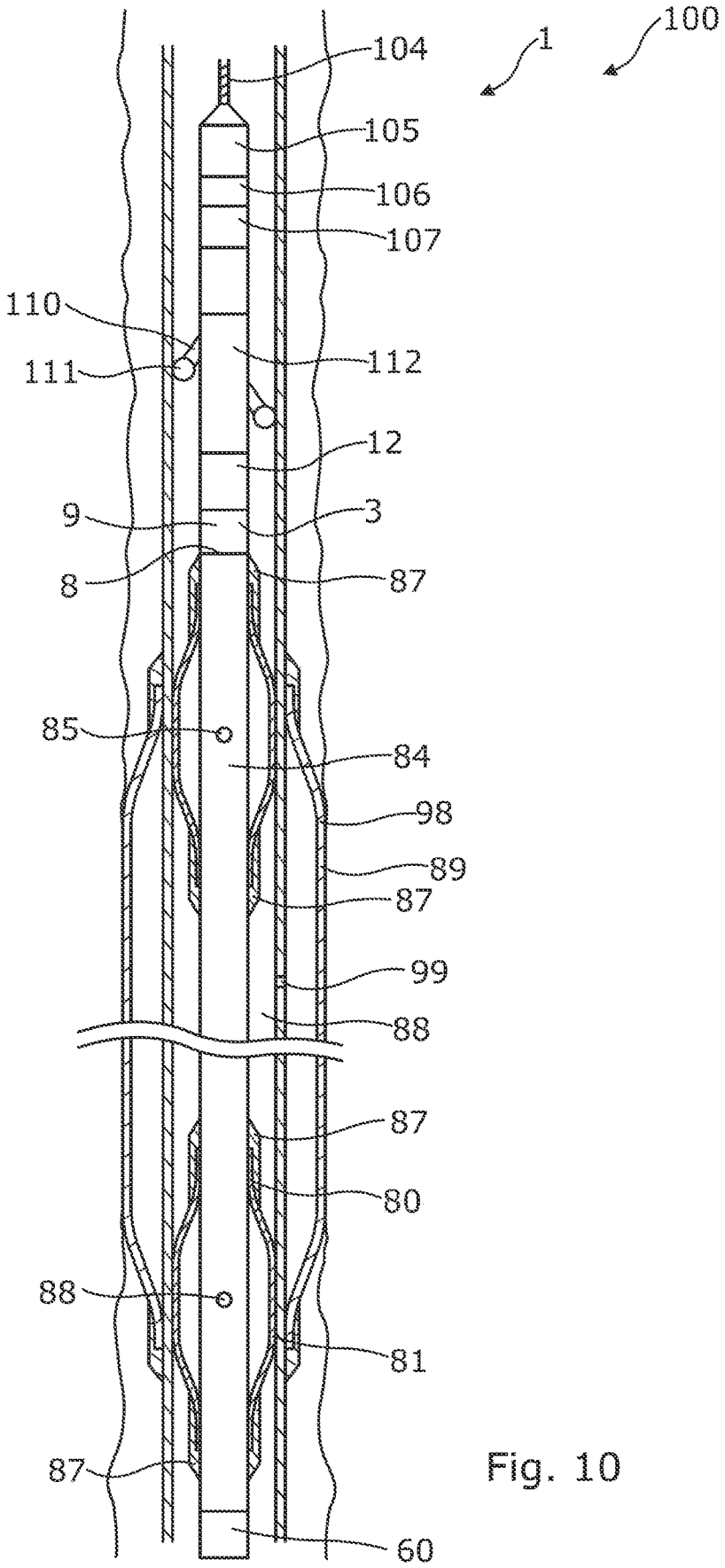
FIG. 10 shows a side view of another downhole positive displacement pump providing a high pressure of fluid in a confined space in each of two packers for expanding an annular barrier outside the well tubular metal structure to provide zonal isolation in the annulus.

As shown in FIG. 7, the downhole positive displacement pump 1 further comprises a discharge control unit 60 for discharging fluid in the packer 80 in order to deflate the packer 80. The packer 80 is shown in its deflated position. The discharge control unit 60 may be a flow-operated discharge control unit 90. In another embodiment, the discharge control unit 60 comprises an electrically operated valve which is operated through an electrical conductor passing through the housing 3 to open a discharge outlet 91 of fluid in the packer 80 out into the well 2 in order to deflate the packer 80. The downhole positive displacement pump 1 is mounted as part of a downhole patch setting tool for setting a patch 81 within a well tubular metal structure by means of at least one inflatable packer 80 arrangeable within the metal patch 81 for expanding the metal patch 81 in the well tubular metal structure 102. The packer 80 having an expandable bladder 83 is arranged around a base pipe 84, as shown in FIGS. 9 and 10. The expandable bladder 83 is expanded via openings 85 in the base pipe 84. The expandable bladder 83 is made of a deflatable material, such as rubber, elastomer, etc., and/or it may be made of a reinforced material. The patch is expanded for sealing off an opening/leak 86, shown in FIG. 7, in the well tubular metal structure. The expandable bladder 83 is connected to a base pipe 84 by connecting sleeves 87.

Figure 8:
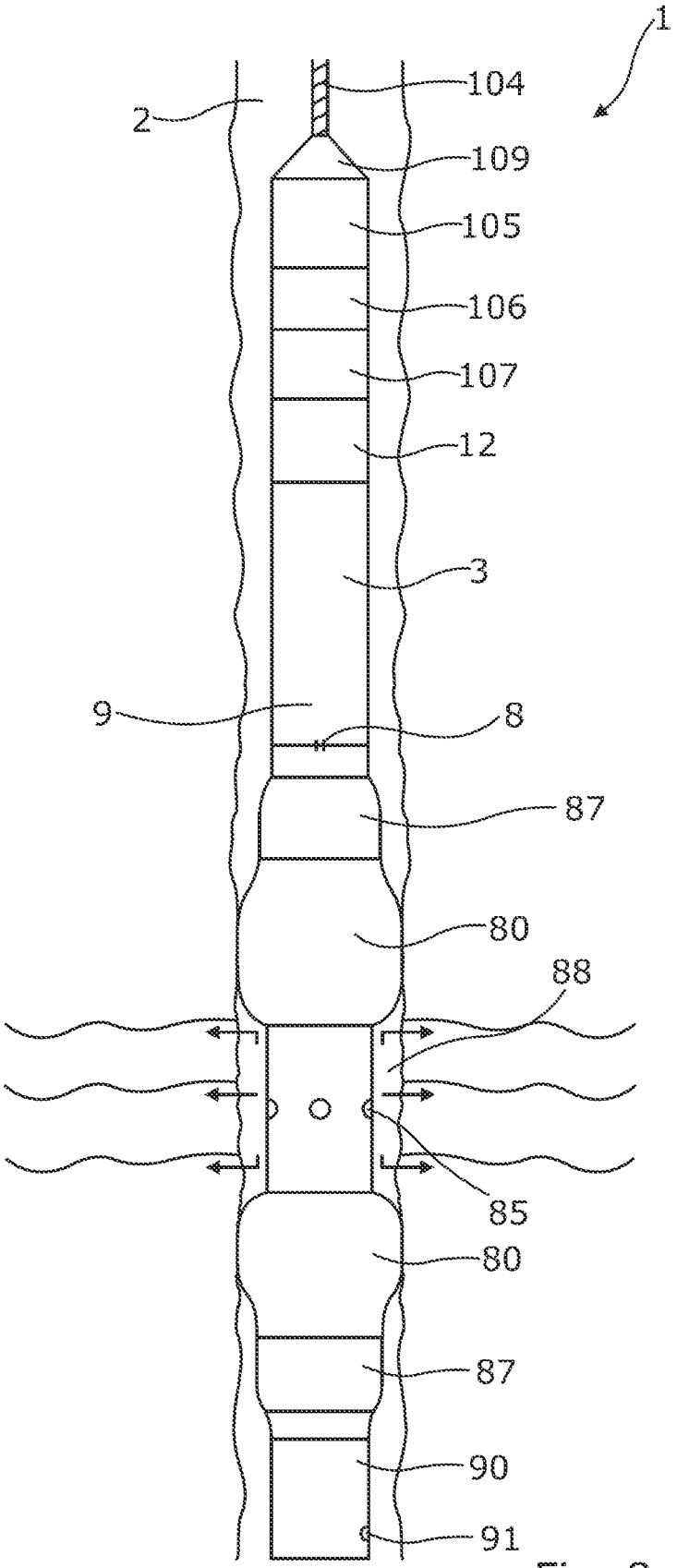
FIG. 8 shows a side view of another downhole positive displacement pump providing a high pressure of fluid in a confined space in each of two packers for isolating a zone down hole in order to fracture the formation.

In FIG. 8, the downhole positive displacement pump 1 comprises two packers 80 mounted with a tool part having openings 85 between them so that a zone in the well 2 is isolated as shown in FIG. 8 in order to pressurise a confined space 88 between two packers 80 in order to fracture the formation. In FIG. 9, the downhole positive displacement pump 1 comprises two packers 80 mounted with a tool part having an opening between them, and a patch 81 is arranged in an overlapping manner with the packers 80 forming a confined space 88, which is pressurised together with the packers 80 to expand the patch by letting fluid out through the openings 85. The downhole positive displacement pump 1 is thus also used to inflate the packers 80 before pressurising the confined space. In FIG. 10, the downhole positive displacement pump 1 comprises two packers 80 mounted with a tool part having at least one opening between them so that a zone in the well tubular metal structure is isolated in order to expand an expandable metal sleeve 98 of an annular barrier 89 through an opening 99 in the well tubular metal structure. The opening 99 may be arranged opposite a valve block of the annular barrier 89 arranged at one end of the annular barrier 89.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas oil and/or water, respectively. Tool fluid is clean fluid and not well fluid.

By "annular barrier" is meant an annular barrier comprising a tubular metal part mounted as part of the well tubular metal structure and an expandable metal sleeve surrounding and connected to the tubular part defining an annular barrier space.

By "casing" or "well tubular metal structure" is meant any kind of pipe, tubing, tubular, liner, string, etc., used downhole in relation to oil or natural gas production.

In the event that the tool is not submersible all the way into the casing, a downhole tractor can be used to push the tool all the way into position in the well. The downhole tractor 112 may have projectable arms 110 having wheels 111 that contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims:

The invention claimed is:

1. A wireline downhole double-acting positive displacement pump for delivering an increased pressure downhole at a location in a well to perform an operation, the well producing hydrocarbon-containing fluid streaming up the well, comprising:

a housing having a first end closest to a top of the well and a second end opposite the first end, the housing having a pump inlet and a pump outlet, where the pump outlet is arranged closer to the second end than to the first end, a wireline connected to the first end, a first chamber arranged in the housing, the first chamber having a first outlet in fluid communication with the pump outlet, a first piston movable in the first chamber for pressing fluid out of the pump outlet, and a drive including an electric motor powered by the wireline and configured to drive the first piston in a reciprocating movement between a first direction and an opposite second direction in the first chamber, and wherein the first piston divides the first chamber into a first chamber part and a second chamber part, the first chamber part comprising the first outlet and a first inlet, a first valve being arranged at the first outlet for allowing fluid to flow out of the first chamber part and preventing fluid from flowing into the first chamber part, a second valve being arranged in the first inlet for allowing fluid to flow into the first chamber part and preventing fluid from flowing out of the first chamber part, the second chamber part comprises a second outlet in fluid communication with the pump outlet and a second inlet, a third valve being arranged in the second outlet for allowing fluid to flow out of the second chamber part and preventing fluid from flowing into the second chamber part, and a fourth valve being arranged in the second inlet for allowing fluid to flow into the second chamber part and preventing fluid from flowing out of the second chamber part, wherein the downhole double-acting positive displacement pump is configured to pump fluid out of the pump outlet when the first piston moves in both the first direction and the second direction, and wherein the downhole double-acting positive displacement pump further comprises a control unit configured to receive an output of the drive and thereby control the movement of the first piston in the first direction or the second direction.

2. The wireline downhole double-acting positive displacement pump according to claim 1, wherein the first piston is connected to a piston rod, and a second piston is connected to the piston rod, the second piston being movable in a second chamber.

3. The wireline downhole double-acting positive displacement pump according to claim 2, wherein the second piston divides the second chamber into a first chamber part and a second chamber part, the first chamber part comprising a first aperture, and the second chamber part comprising a second aperture.

4. The wireline downhole double-acting positive displacement pump according to claim 3, wherein the control unit is configured to, in a first position, direct pressurised fluid into the first chamber part of the second chamber and, in a second position, direct pressurised fluid into the second chamber part of the second chamber.

5. The wireline downhole double-acting positive displacement pump according to claim 3, wherein the drive includes a second pump configured to be driven by the electric motor, and a discharge opening of the second pump fluidly connected to the first aperture in a first position and fluidly connected to the second aperture in a second position.

6. The wireline downhole double-acting positive displacement pump according to claim 5, further comprising a second drive having the discharge opening.

7. The wireline downhole double-acting positive displacement pump according to claim 5, wherein the control unit comprises a valve unit comprising a valve chamber and a valve piston moving in the valve chamber between a first valve position and a second valve position, the valve chamber having a valve inlet fluidly connected with the discharge opening, a first valve outlet fluidly connected with the first aperture and a second valve outlet fluidly connected with the second aperture, and in the first valve position the valve inlet is fluidly connected with the first valve outlet, and in the second valve position the valve inlet is fluidly connected with the second valve outlet.

8. The wireline downhole double-acting positive displacement pump according to claim 7, wherein the flow control unit further comprises a pivot arm having a first arm end part and a second arm end part, the second arm end part being connected with the valve piston in order to change between the first valve position and the second valve position.

9. The wireline downhole double-acting positive displacement pump according to claim 8, wherein the pivot arm pivots around a pivot point.

10. The wireline downhole double-acting positive displacement pump according to claim 3, wherein the control unit is a flow control unit directing the fluid from the discharge opening to either the first aperture or the second aperture for moving the second piston in the second chamber.

11. The wireline downhole double-acting positive displacement pump according to claim 10, wherein the control unit further comprises a first moving element and a second moving element, the second moving element moving the first moving element and the pivot arm so as to move the valve piston in order to change between the first valve position and the second valve position.

12. The wireline downhole double-acting positive displacement pump according to claim 11, wherein the second moving element is connected with and driven by the piston rod.

13. The wireline downhole double-acting positive displacement pump according to claim 10, wherein the control unit further comprises a first moving element, the first moving element having a projecting flange with a flange surface along which the first arm end part of the pivot arm moves.

14. The wireline downhole double-acting positive displacement pump according to claim 13, wherein the flange surface has a first surface end and a second surface end, the flange surface inclining from an intermediate point towards the first surface end in order to move the valve piston from the first valve position to the second valve position, and the flange surface inclining from the intermediate point towards the second surface end in order to move the valve piston from the second valve position to the first valve position.

15. The wireline downhole double-acting positive displacement pump according to claim 1, wherein the electric motor is configured to directly drive the first piston via gearing.

16. The wireline downhole double-acting positive displacement pump according to claim 1, wherein the drive includes a second pump associated with the electric motor, the second pump having a second piston configured to drive the first piston.

17. A downhole patch-setting tool for setting a patch within a well tubular metal structure, comprising the wireline downhole double-acting positive displacement pump according to claim 1 and at least one inflatable packer arrangeable within a metal patch for expanding the metal patch in the well tubular metal structure.

* * * * *